US005660071A

United States Patent [19]

Sauvonnet et al.

[11] Patent Number: 5,660,071

[45] Date of Patent: Aug. 26, 1997

[54] AUTOMATIC DRAWING DEVICE

[75] Inventors: Jean-Louis Sauvonnet, Cremieu; Jean Lemire, Fromelennes; Lionel Robbe, Sezanne; Jean Chouvel, Courbevoie, all of France; Bruno Ceccacci, Chiavari, Italy

[73] Assignee: Trefimetaux, Courbevoie, France

[21] Appl. No.: 618,563

[22] Filed: Mar. 20, 1996

[30] Foreign Application Priority Data

Mar. 24, 1995 [FR] France ..... 95 03742

[51] Int. Cl.[6] ..... B21C 1/24; B21C 1/30

[52] U.S. Cl. ..... 72/283; 72/290; 72/422

[58] Field of Search ..... 72/290, 291, 287, 72/283, 405.02, 422

[56] References Cited

U.S. PATENT DOCUMENTS 1,911,157 5/1933 Leech .

FOREIGN PATENT DOCUMENTS 514665 10/1952 Belgium .
645200 3/1995 European Pat. Off. .

*Primary Examiner*—Daniel C. Crane
*Attorney, Agent, or Firm*—Dennison, Meserole, Pollack & Scheiner

[57] ABSTRACT

A drawing device including a drawing block and a traction device, where the traction device includes two drive belts and an automatic engagement device. This automatic engagement device includes an auxiliary traction device propelled with power by the traction device.

16 Claims, 6 Drawing Sheets

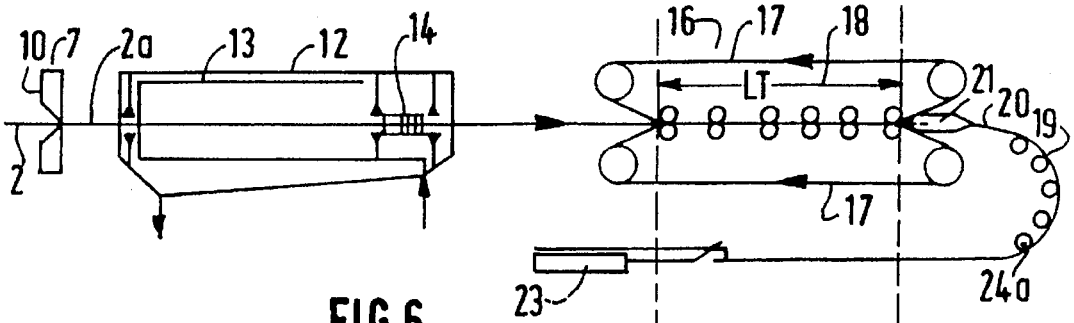
FIG.6
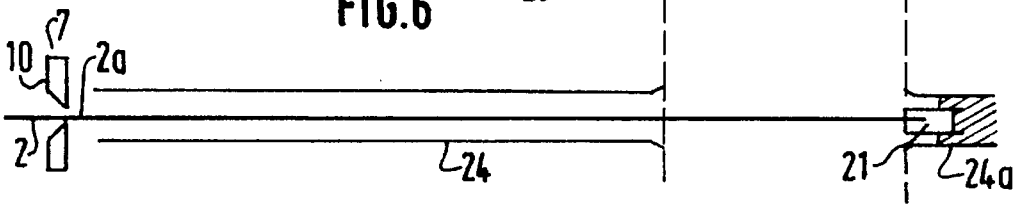
FIG.6a
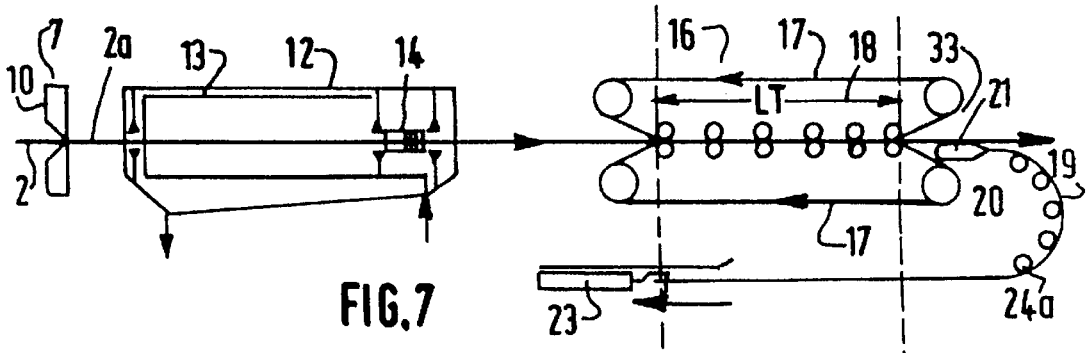
FIG.7
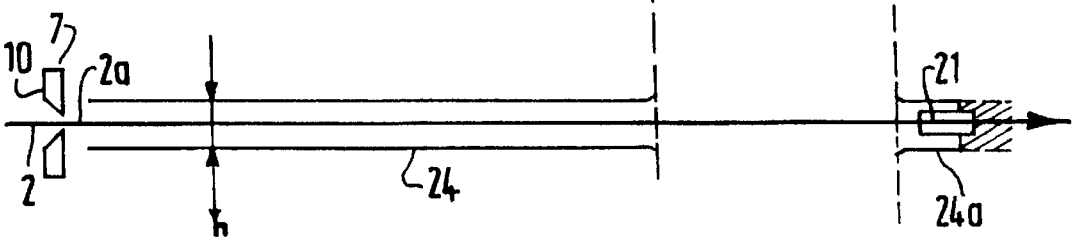
FIG.7b
FIG.7a

AUTOMATIC DRAWING DEVICE

FIELD OF THE INVENTION

The invention relates to the field of the shaping of materials by drawing or drafting to reduce the dimensions of metallic articles having a great length, typically tubes, in one or more drawing passes.

DESCRIPTION OF RELATED ART

The drawing of long metallic products, in particular tubes, is typically carried out using the means shown in FIG. 1.

FIG. 1 illustrates schematically a standard drawing device of the "ROTUBLOC" (R) type and the use of this drawing device in batches of 8 baskets of tubes per drawing pass:

For one drawing pass and therefore a given die, 8 ring-type tube baskets arranged on a turntable travel successively before the drawing block where a full basket supplies the die with tube while the following empty basket receives the drawn tube.

At each change of die, the 7 baskets of tubes travel before the drawing block as many times as there are drawing passes, generally 5 to 10 times.

At the end of drawing, the baskets of drawn tubes are displaced toward a cropping station where the drawn tubes are cut to length and packaged.

The problems posed by the state of the art device are of three types:

On the one hand, although the intrinsic technical performance of this device is high in itself as the instantaneous speed of the tube on a "ROTUBLOC" (R) device can reach 1000 m/min, its overall productivity is inadequate insofar as the effective speed is only about 250 m/min and for a single drawing pass.

On the other hand, "ROTUBLOC" (R) drawing devices constitute relatively expensive drawing means.

Finally, drawing with a "ROTUBLOC" (R) involves the transfer of the baskets of drawn tubes to a separate cropping station at the end of drawing.

The applicants have therefore sought and developed a device which simultaneously allows:

the productivity of drawing to be increased, the investment costs to be limited, the finishing and cropping stage to be integrated in the drawing stage.

SUMMARY OF THE INVENTION

According to the invention, the device for the drawing of a long metallic product comprises a drawing block and a device for the traction of said long drawn metallic product in series and is characterized in that, a) said traction device comprises two close driving belts rotating in opposite directions which drive said long drawn metallic product linearly, b) said drawing device comprises a device for the automatic engagement of the tapered end of said long drawn product from the outlet of said drawing block to the outlet of said traction device, c) said automatic engagement device comprises an auxiliary traction means propelled with power by said traction device.

The invention will be understood better by means of the drawings which show a non limiting embodiment of the invention.

BRIEF DESCRIPTION OF THE DRAWINGS

FIGS. 3, 4, 5, 6 and 7 are vertical cross-sectional views of an automatic drawing device according to the invention;

FIGS. 3*a*, 4*a*, 5*a*, 6*a*, 7*a* and 7*b* are partial plan views of the devices of FIGS. 3, 4, 5, 6 and 7, respectively;

DESCRIPTION OF THE PREFERRED EMBODIMENTS

Figure 1:
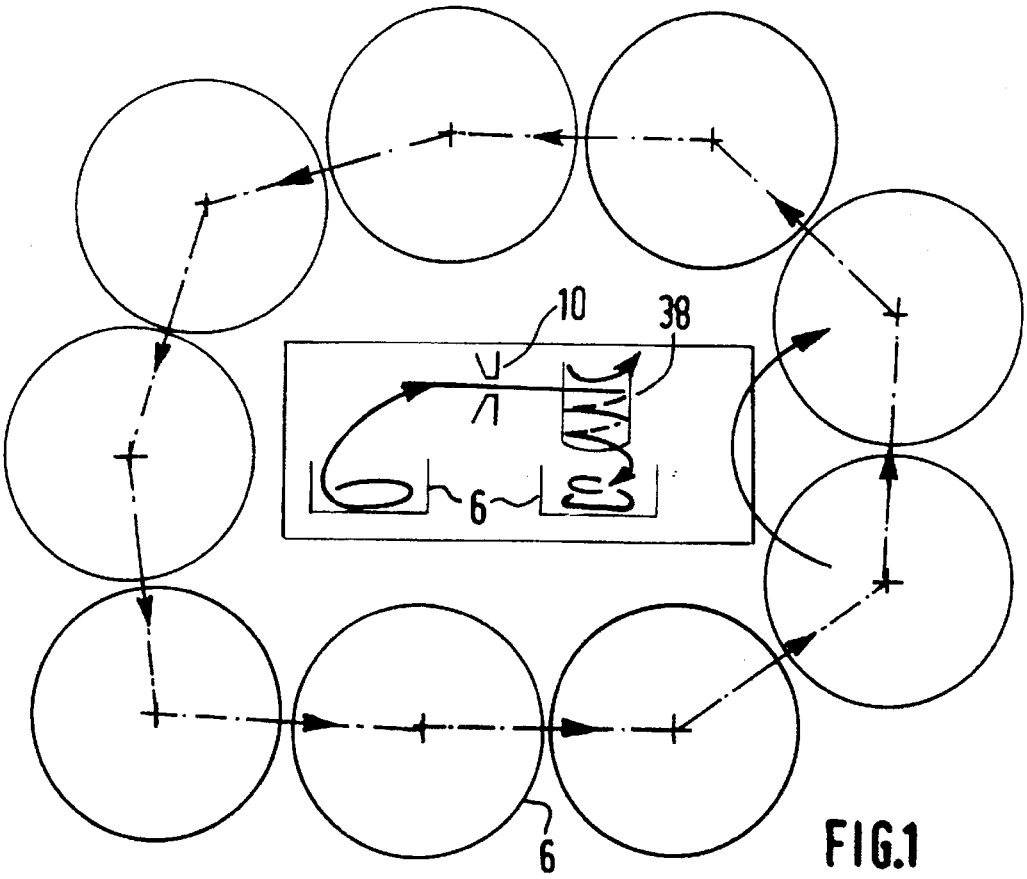
FIG. 1 is a schematic diagram of a prior art drawing device.

FIG. 1 shows the state of the art. It is a schematic view of the layout on the ground of the "ROTUBLOC" (R) drawing device: the "ROTUBLOC" drawing system comprises a drawing die 10 and a capstan 38 type traction system, as shown by the central rectangle in FIG. 1. Use of this system necessitates the presence of two baskets 6: a ring tube basket for supplying the die and a drawn tube receiving basket in the form of a ring. A turntable allows the baskets to travel before the drawing die 10.

Figure 2:
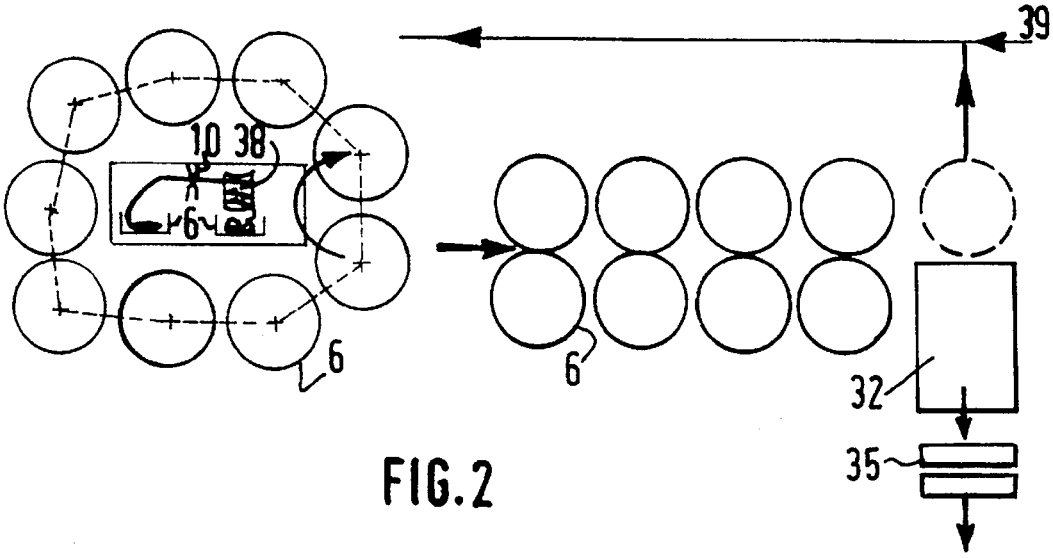
FIG. 2 is a schematic plan view of the device of FIG. 1.

FIG. 2 is a schematic plan view of the location on the ground of the drawing means shown in FIG. 1 and of the cropping means 32 supplied with baskets 6 of drawn tubes intended to produce drawn tubes which are cut to length and packaged 35, the empty baskets 6 then being loaded with tube lengths 39 (coming from the upstream drawing machines) to be drawn and directed to the drawing means.

FIGS. 3, 4, 5, 6 and 7 are sectional views in a vertical plane of the automatic drawing device according to the invention, illustrating the phase of automatic engagement of the long product 2 from the die outlet 10 of the drawing block 7 to the outlet 33 of the traction means 16 comprising two traction belts or caterpillar tracks 17 which define a traction length LT 18. The automatic drawing device comprises a drawing block 7, a cooling block 12 and a traction device 16 in line. The drawing block 7 comprises a drawing die 10 and optionally a notch generator 37—only shown in FIG. 3 to simplify the drawings. The cooling block 12 comprises washing and cooling units 13 and a wiping box 14.

The corresponding FIGS. 3*a*, 4*a*, 5*a*, 6*a* and 7*a* complement the foregoing figures. They are partial views in a horizontal plane intended to illustrate certain elements of the automatic engagement device 19 (abbreviated to DEA) according to the invention, in particular the guide means 24 of the DEA comprising an attachment means 21 integral with the end of a steel ribbon 20 constituting said auxiliary traction means.

Figure 3:
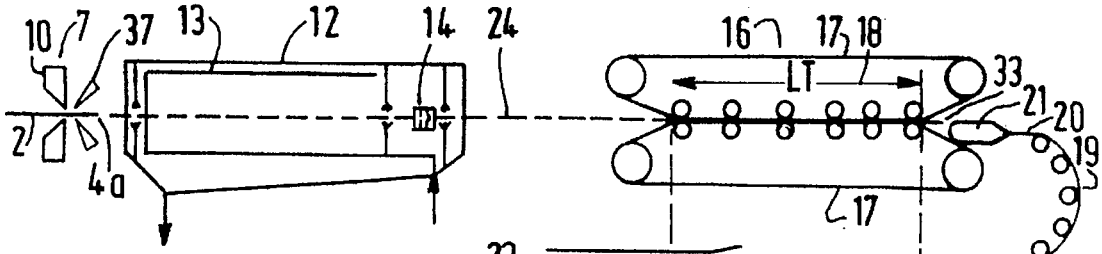
Figure 3A:
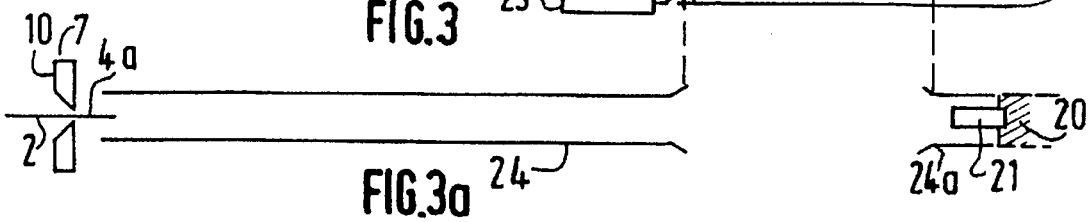

FIGS. 3 and 3*a* show the initial state of the automatic drawing device before start up of the DEA 19: the end 4*a* of the point 4 projects from the outlet of the drawing die 7, and the DEA 19 is not activated: the attachment means 21 is kept at a small distance from the outlet 33 of the traction device 16.

Figure 4:
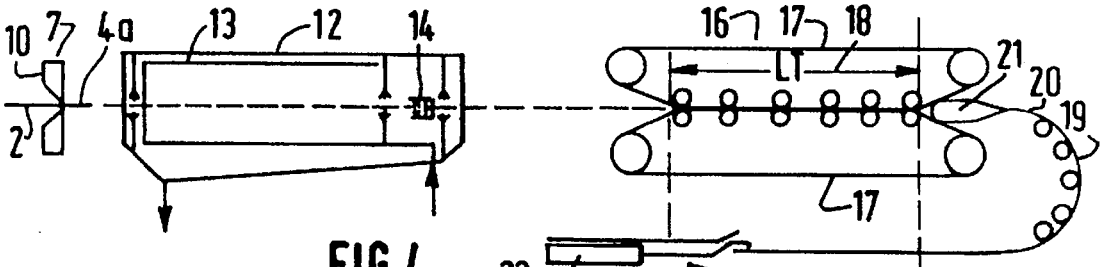
Figure 4A:
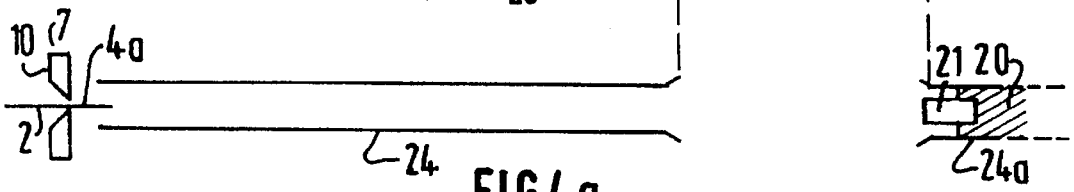

FIGS. 4 and 4*a* show the activation of the DEA, that is the travel of the DEA 19 by means of the jack 23 in such a way that the attachment means 21 is at the outlet 33 of the traction device 16.

Figure 5:
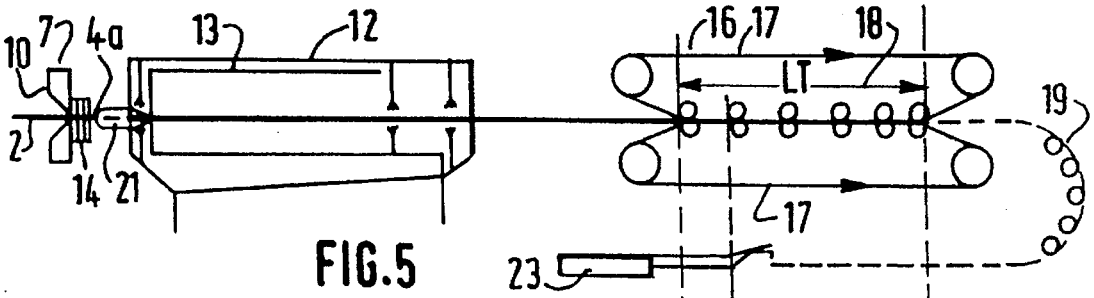
Figure 5A:
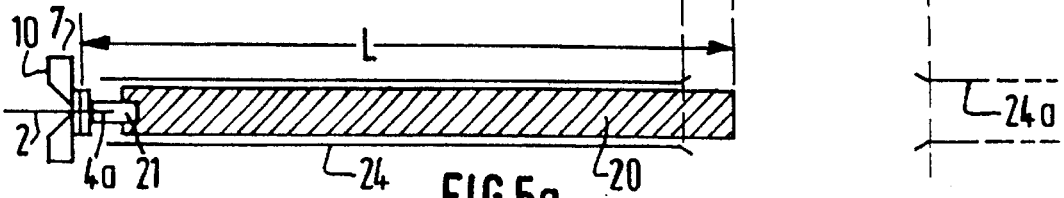

FIGS. 5 and 5*a* show the travel of the DEA by reverse travel of the traction device 16: the attachment means 21 traverses the traction device 16 and the cooling block 12 while pushing the wiping box 14 which consists of scraper joints and is also guided by guide means 24 against the drawing die 10 and automatically attaches the end 4*a*. There are guide means 24 between the outlet of the drawing block 7 and the inlet of the traction device 16. There are guide means 24*a* at the outlet 33 of the traction device 16, as shown in FIGS. 3*a*, 4*a*, 5*a*, 6*a* and 7*a*. FIG. 5*a* shows the length L of the assembly consisting of the auxiliary traction means 20 and the attachment means 21, this length corresponding to the distance between the outlet of the drawing block 7 and the inlet of the traction block device 16 increased by the length of band necessary for the driving of the auxiliary traction means 20 by the traction device 16—that is about 9 m in total in the case of a "caterpillar" type traction device 16 capable of exerting a force of 2 tonnes (20,000N) for example. In fact, this length depends on the length of the cooling box and the power of the "caterpillar" which is translated by the length of contact (or again length in engagement) in the "caterpillar".

In the foremost position, the steel band comes just to the bottom of the curve which leads to the sort position.

FIGS. 6 and 6*a* illustrate the following stage where the traction device 16 is put into forward operation again: the drawn product 2*a* is drawn through the die then traverses the cooling block 12 and drives the wiping box 14 to the cooling block while the auxiliary traction means 20 comes back into the position which it had in FIGS. 4 and 4*a*, the attachment means 21 then being at the outlet 33 of the traction device 16 whereas the other end of the auxiliary traction means 20 is attached to the jack 23 by the guide means 24*a*.

FIGS. 7 and 7*a* illustrate the deactivation of the DEA by the action of the jack 23: the attachment means 21 is removed from the outlet 33 to allow the free passage of the drawn product 2*a*, the auxiliary traction means 20 assuming a parking position already shown in FIG. 3. FIG. 7*b* is a cross section showing the shape of the guide rails (two U-shaped rails).

Figure 8:
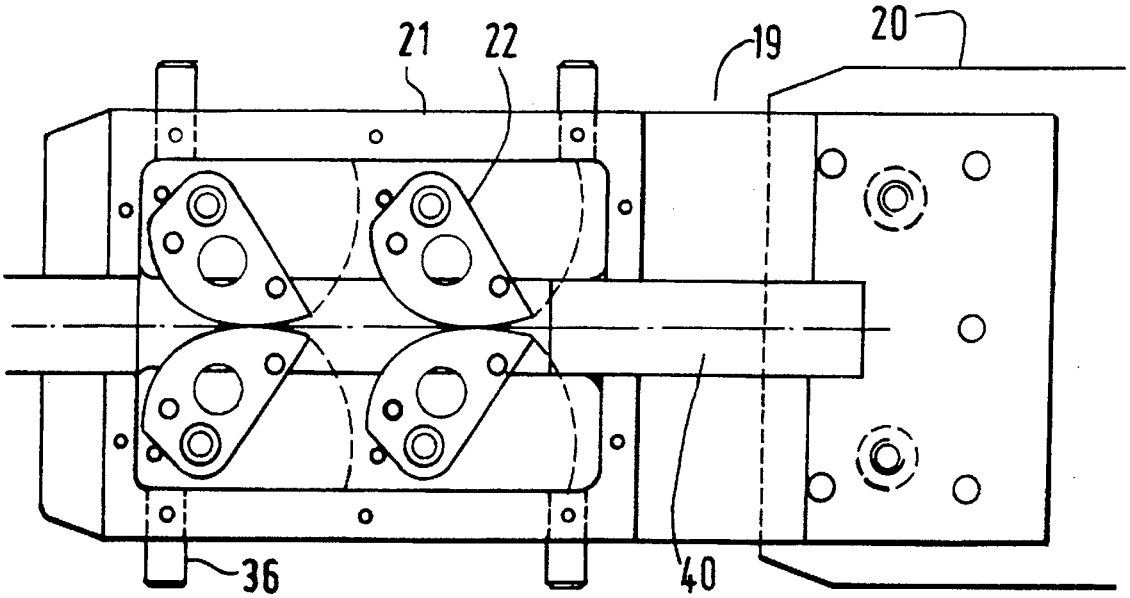
FIG. 8 is a plan view of an automatic engagement device according to the invention.
Figure 8A:
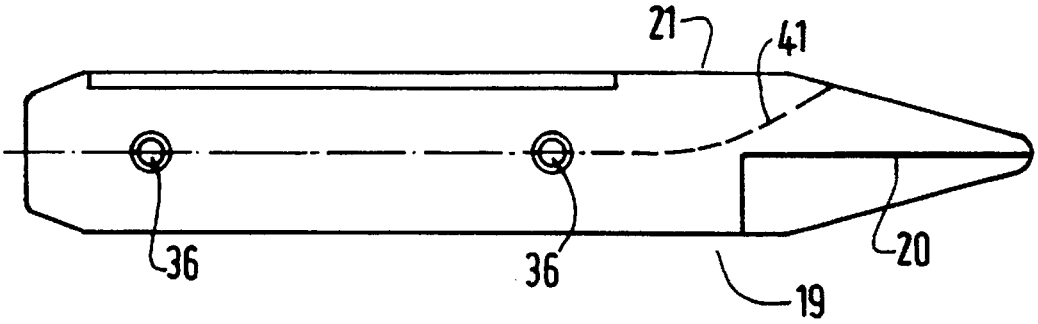
FIG. 8*a* is a side view of the engagement device of FIG. 8.
Figure 8B:
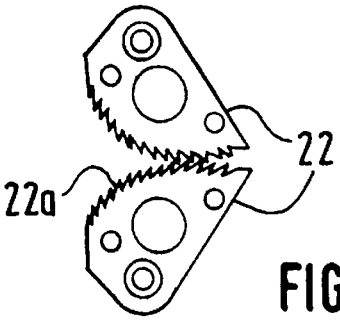
FIG. 8*b* is a plan view of a pair of cams for the automatic engagement device of FIG. 8.

FIGS. 8, 8*a* and 8*b* relate to the automatic engagement device 19.

FIG. 8, is a plan view showing the attachment means 21 fixed to one end of the steel ribbon 20. The attachment means comprises 4 cams 22 facing one another in pairs, as shown by means of the weak restoring springs (<1 daN) and has a guide channel 40. The attachment means 21 also carries guide studs 36 in the guide rails 24.

FIG. 8*a* is a side view of the attachment means 21. The upper portion is occupied by the cams (not shown) and the right-hand portion allows the steel ribbon of small thickness 20 to be fixed to the attachment means 21. The outlet ramp 41 of the guide channel 40 is shown as a broken line.

FIG. 8*b* is a plan view of a pair of cams 22 of which the active surface is equipped with teeth 22*a* orientated so that the point 4 of the long product to be drawn does not risk slipping and becoming detached from the attachment means when the attachment means exerts traction on said point.

Figure 9:
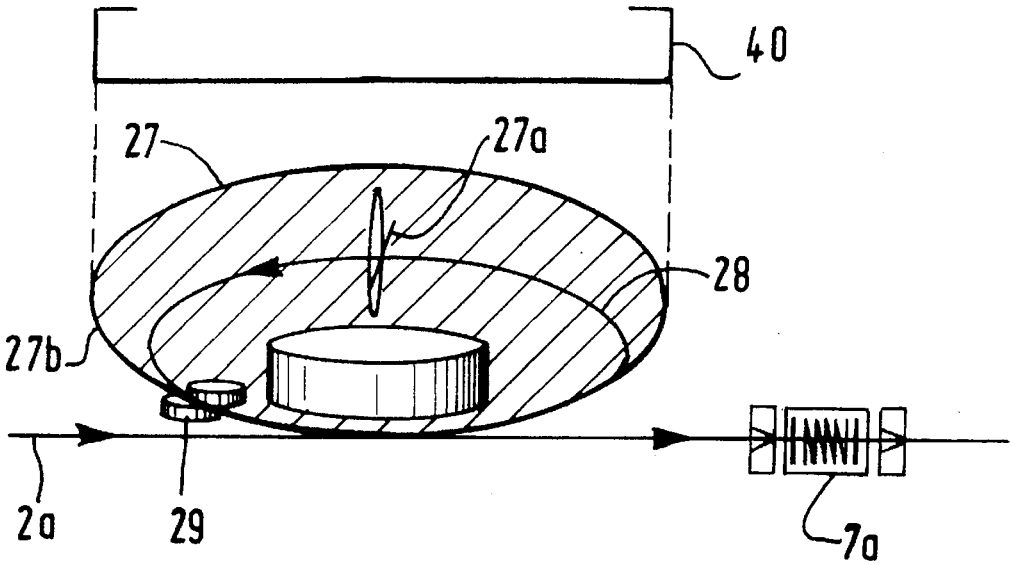
FIG. 9 is a diagram of a synchronization system disposed between two successive drawing blocks according to the invention.

FIG. 9 is a diagram of the synchronization system 27 located between two successive drawing blocks 7, 7*a*, 7*b* comprising a plate 27*b* supporting a loop 28 of long drawn product 2*a*, 2*b*, 2*c* of which the diameter is measured by a sensor 27*a*, an acceleration motor 29 or "pinch roll" at the outlet of the loop 28. This plate 27*b* has a rim 40 in the form of an inverted "U" which allows guidance of the long drawn product.

Figure 10:
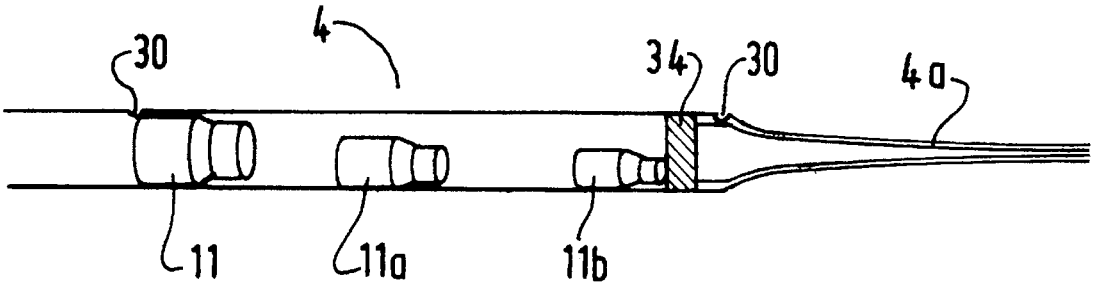
FIG. 10 is a longitudinal cross-sectional view of a tube drawn in three drawing passes.

FIG. 10 is a longitudinal section through the point 4 of a tube to be drawn in 3 drawing passes. It comprises 3 mandrels 31, 31*a*, 31*b*. Notches 30 and one or more stoppers 34 can be used to hold the mandrels in a limited space, and optionally the lubricants for the drawing mandrels.

Figure 11:
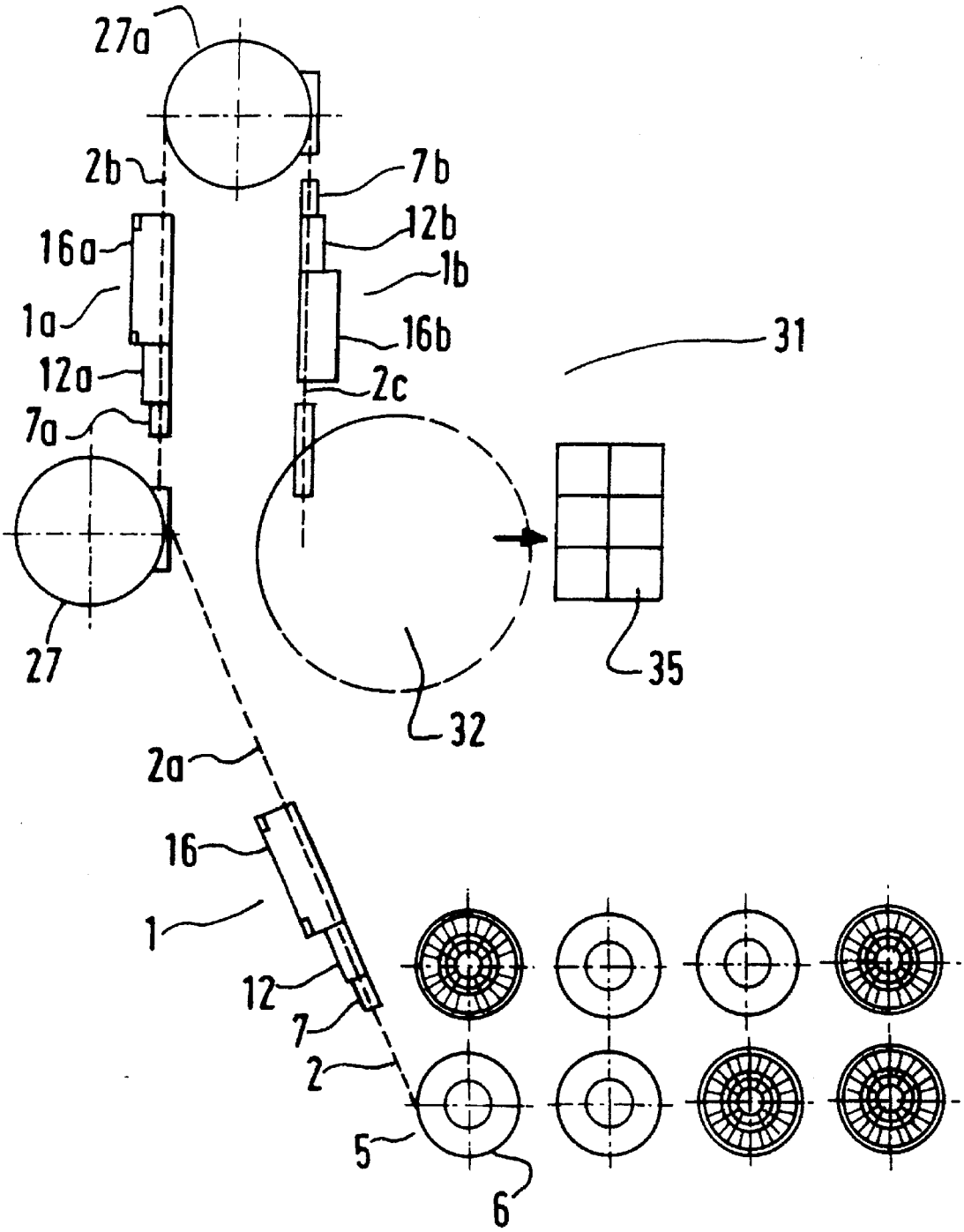
FIG. 11 is a schematic diagram of a drawing line including three drawing devices according to the invention.

FIG. 11 shows a drawing line 31 comprising, in series:

a reeling assembly 5 with 8 baskets 6 containing the long products 2 to be drawn, a first drawing device 1 with a drawing 7, a cooling block 12, a traction device 16 and an automatic engagement device 19 not shown in the figure, forming the long drawn product 2*a*, a regulating system 27, a second drawing device la similar to the first one, forming the long drawn product 2*b*, a second regulating system 27*a*, a third drawing device 1*b* similar to the previous ones, forming the long drawn product 2*c*, a cropping station 32 for the cutting to length and final packaging 35 of the drawn semi-finished products obtained. If necessary, this cropping station can be replaced by a device for winding and receiving in a basket for other transformation operations (annealing, drawing, grooving, sheathing, etc.).

The generic means of the invention can assume various concrete forms. According to one embodiment, the automatic engagement device 19 comprises:

a) an auxiliary traction means 20 of limited length of which one end is integral with an automatic attachment/detachment means 21, said length being such that, when said attachment means is fixed to said tapered end of said long product 2 leaving said drawing block, said auxiliary traction means is in engagement at its other end with said traction device. It can also traverse said traction device 16 over its entire length and its other end can be located beyond said traction device 16, b) guide means 24 of said auxiliary means 20 over all or part of the trajectory extending from the outlet of said drawing block 7 to the outlet of said traction device 16 and at the outlet of said traction device 16, c) means for forward and reverse travel of said auxiliary means 20 comprising said traction device 16. These forward and reverse travel means can also comprise a secondary means 23 for displacing and engaging or disconnecting said attachment means 21 with said traction device 20 at the outlet thereof.

FIGS. 3 to 7 and 3*a* to 7*a* illustrate the automatic drawing device according to the invention is a detailed manner, this device comprising, on the one hand in line, drawing means: drawing block 7, cooling block 13 and traction device 16 and, on the other hand, an automatic engagement device 19 integrated in these drawing means. As shown clearly, the invention allows not only the automatic engagement of the tube to be drawn in a die but also the engagement of the tube up to the outlet 33 of the traction device 16. This is an essential element of the invention: in fact, the invention aims not only to solve the above-mentioned problems but also to manufacture long drawn products, mainly but not exclusively tubes, having an excellent surface state—and this rules out numerous traction devices which damage and mark the surface of the long product to be drawn.

As a result of their tests, the applicants have come to the conclusion that the problems of both an economic and qualitative nature could not be solved without coupling a traction device based on the use of two close driving belts which grip said long drawn product over sufficient length to exert the pull and to drive it by mere pressure of the driving belts without damaging it, and this necessitated an automatic engagement device precisely allowing the engagement of the long product to be drawn up to the outlet 33 of the traction device 16.

The automatic engagement device 19 according to the invention also comprises various particular means for its use. Thus, said auxiliary traction means 20 is selected so as to have, in forward travel, sufficient resistance to traction to be able to pull said long product 2*a* from the outlet of said drawing block 7 through said cooling block 12 to the outlet of said traction device 16 and to have, in reverse travel, sufficient resistance to compression for said automatic attachment/detachment means 21 to be displaced to the outlet of said drawing block 7 owing to said guide means 24.

Said auxiliary traction means 20 is preferably a steel ribbon of which the lateral position is ensured by rails constituting said guide means 24. However, this steel ribbon can be replaced by any other device for transmitting movement and force, for example a cable inserted in small cylindrical sleeves or again, for example, a ribbon in the form of portions of articulated rods, or of a chain formed by articulated links.

When the auxiliary traction means 20 is not activated, it has to be positioned at the outlet of said traction device 16 by a guiding and parking means 24*a* of said auxiliary traction means 20 and said attachment means 21.

To activate or deactivate the automatic engagement device 19, that is to present or remove the attachment means facing the outlet 33 of the traction device 16, said secondary means 23 can be a jack 23 as shown in FIGS. 3 to 7 or a driving shaft or any other equivalent means.

According to the invention, said automatic attachment/detachment means 21 consists of two orientated toothed cams 22 allowing said end of said tapered long product 2 to be gripped once and while the automatic attachment/detachment means 21 exerts traction on said end in forward travel. See FIG. 8.

As illustrated in FIG. 8*b*, said cams 22, preferably have a profile in the form of a logarithmic spiral so as to exert pressure on the point which is proportional to the traction when manufacturing tubes of which the diameters can vary within a fairly wide range.

The drawing device according to the invention can comprise a cooling block 12 with which a wiping box 14 is associated. This wiping box 14, of which the central orifice is adapted to the drawn product 2*a*, is translatable owing to said guide means 24 and by the thrust of said attachment means 21 to the outlet of said drawing block 7. A cooling block 12 is not necessary as such to carry out the invention but, in view of the need to exert traction on the long drawn metallic product without damaging it, it is preferable to use non-abrasive materials, in particular plastics materials or elastomers which can have limited thermal stability, for the driving belts of the traction device 16. In this case, it is important to cool the long drawn metallic product, typically by cold water sprinkling, and to wipe it before it engages between said close driving belts.

According to the invention, said traction device 16 is a device with belts or caterpillar tracks 17 capable of exerting a pull over a sufficient length LT 18, typically of 1 to 3 m, depending on the pulls required and the frictional forces between the long drawn product and said belts without damaging the long drawn products. The driving belts consist, for example, of strips of elastomeric material or of rubber held against one another by pressing and/or driving rollers. The driving belts 17 could also be replaced by a succession of pairs of rollers which would have an equivalent function, the essential feature being that the length of traction LT 18 between the driving belts and said long drawn product is sufficient to exert the pull required for drawing without damaging the surface of the long drawn product.

As shown in FIG. 3, with regard to the drawing of tubes, the device according to the invention can comprise, at the outlet of the drawing block 7, a means 37 for forming a notch 30 to reduce the internal diameter of said tube and, at start up, to facilitate the positioning of the mandrel adapted to each die. The means 37 shown in FIG. 3 corresponds to two cams which, when rotated, lead to the formation of a notch 30 of the type shown in FIG. 10.

In fact, the drawing of tubes necessitates the presence of a mandrel 11 inside the tube which has to be taken in the drawing die when drawing the tube. The aim of the notch 30 is to allow the engagement of the smallest diameter portion of the mandrel 11 in the die 10. In the absence of a notch 30, there is a risk that the mandrel would slide. This notch is only produced in the region of the point 4 of the tube to be drawn in the case of an intermediate drawing pass since the notch produced during engagement of the point of the tube is intended to allow the engagement of the mandrel in the following drawing pass, as will be explained hereinafter.

The drawing device according to the invention comprises means for automating the sequential implementation of the various movements allowing the implementation of said automatic engagement means:

a) reverse operation of said secondary means 23 so as to present said attachment means 21 at the outlet of the traction device 16, b) and stoppage of said secondary means during reverse operation of said traction device 16, c) reverse operation of the traction device 16 until said attachment means 21 has gripped said end of said tapered long product 2, d) forward operation of the traction device 16, and optionally automatic production by a notch generator 37 of a notch 30 after travel of said end over a given predetermined length, e) and, when said attachment means 21 arrives at the outlet of said traction device 16, temporary forward travel of said secondary means 23 to remove said attachment means 21 from the outlet of said traction device 16.

The means of automation used are known as such and can optionally be complemented by any type of sensor, typically a sensor of the presence of long product, a speed sensor, a temperature sensor, allowing reliable use of the drawing device according to the invention.

The invention also relates to a drawing line 31 comprising as many drawing devices of the type already described as there are desired drawing passes, in series. This line comprises, between two successive drawing devices, a regulating device 27 allowing the guidance of said long drawn product 2*a* toward the inlet of the following drawing block 7*a*, toward a cropping station or toward any other drawn tube processing station.

According to a variation shown in FIG. 9, said regulating device 27 allows the formation of a loop 28 of said long drawn product and comprises travel means 29, typically driving rollers between which the long drawn product passes at the end of the loop, and a loop position sensor 27*a*. Although FIG. 9 shows the long drawn product entering and leaving said loop as being colinear, the loop regulating device 27 does in fact allow the long drawn product to be orientated in the desired direction at the loop outlet, as shown clearly in FIG. 11.

The invention therefore allows several drawing devices according to the invention, typically 3 to 5, to be arranged in series, according to decreasing die diameter and allows a drawing line 31 according to the invention to be made up, as shown in FIG. 11. A system for synchronizing these devices is necessary, in particular because the linear velocity of the long drawn products increases at the outlet of each die. This synchronization system allows interlinking of drawing passes with different elongations (for example 160% of drawing in the first pass, 130% in the second pass, etc.), contrary to the drawing systems of the prior art which are designed only for a given drawing range.

The drawing line 31 therefore generally comprises means for checking the position and speed of said long product 2, 2*a*, 2*b* . . . , means for checking the diameter of each regulating loop 28, means for synchronizing the various linear velocities of said long drawn products at the outlet of each drawing block by acting on the speed imposed on the traction devices 16 and/or on the travel means 29, so there is neither an accumulation of nor excessive tension in said long drawn products between two successive drawing blocks 7, 7*a*.

The invention can be used for drawing products in rings such as tubes, wires or rods. The invention can also be used for drawing straight metallic products such as rods and tubes.

EXAMPLE

A complete drawing line 31 was produced, as shown in FIG. 11. This line 31 comprises 3 drawing devices 1, 1*a*, 1*b* followed by a cropping station 32 which delivers rings of packaged tubes 35 ready to be marketed. It has allowed passage from a tube diameter of 18 mm to a diameter of 9.52 mm in 3 drawing passes.

This line is supplied by baskets 6 of tubes to be drawn.

Each drawing device 1, 1*a*, 1*b* comprises a drawing block 7, 7*a*, 7*b*, a cooling block 12, 12*a*, 12*b* and a caterpillar track-type traction device 16, 16*a*, 16*b* equipped with belts 17 typically of rubber, in series.

Between two drawing devices 1 and 1*a*, 1*a* and 1*b*, a loop-type regulating device 27, 27*a* allows the drawn tube to be orientated, in particular, in the desired direction and allows the necessary flexibility between two successive drawing devices to be ensured so there is no local accumulation or lack of drawn tube. The line 31 comprises means for guiding the drawn tube which is right along the line and of which the positioning is continuously checked—except in the region of the loop 28 of the regulating device 27 intended to absorb impacts. The system for the automatic control and synchronization of the line, which is known as such, has not been shown in FIG. 11.

Operation of this drawing line can be described in the following manner:

For each basket of ring of tube to be drawn, the operator has to produce a point as shown in FIG. 10, using a device provided for this purpose, after having previously positioned 3 mandrels 11, 11*a*, 11*b* adapted to the 3 drawing dies 10, 10*a*, 10*b*, not shown. He has to produce a notch 30.

He manually introduces the end 4*a* of the point 4 of the tube into the first die 7.

It is then sufficient to start up the line according to the invention for all the operations to the cropping station to be automatically interlinked.

The point can generally be prepared in masked time so, overall in this embodiment, the average productivity for simultaneously carrying out the 3 last drawing passes and cropping is between 150 and 250 m/min (effective speed) for a maximum speed of the order of 400 m/min in this example, but it can be higher than 1800 m/min.

The drawing devices according to the invention as such are already of great interest for the economic manufacture of long drawn products having a high quality surface. However, the invention is devoted to the production of drawing lines 31 according to the invention. In fact, if a line 31 such as the one in the embodiment is compared with state of the art devices, the productivity is multiplied by about 2 with regard to the mere drawing aspect since the line 31 performs 3 drawing passes at the effective speed of 200 m/min whereas the state of the art device produces 1 pass at an effective speed of 250 m/min.

It is important to note that, in the case of the state of the art, cropping is an operation which is carried out separately and is not integrated as in the line 31 according to the invention which affords a great reduction in handling and in the labour costs and also eliminates the risks of damaging the tubes. The possibility of integrating cropping (or any other processing or finishing treatment on the drawn tube) in the drawing of the tube results from the fact that the invention allows total guidance of the long drawn product, and the perfectly defined trajectory of the long drawn product can be assimilated to a broken straight line, each change of direction being permitted by a regulating device 27 with a loop of long drawn product 28. On the other hand, the state of the art drawing means which transforms a ring of tube into another ring of drawn tube does not allow the cropping operation—or any other operation—to be integrated in drawing of the tube.

Furthermore, with identical production, the cost of a line 31 according to the embodiment is about 4 times less than that of the equipment corresponding to the state of the art including the drawing and cropping means, and if the bulk on the ground of a line 31 according to the embodiment and that of the state of the art equipment shown in FIG. 2 is compared, this bulk is about 2 times smaller with a line 31 according to the invention.

Furthermore, the invention is not limited to the embodiment and allows various possibilities to be implemented owing to the modular design of a drawing line. For example, all tube drawing passes can be carried out with 2 lines of 4 drawing devices each, the second and last line comprising the cropping station.

Finally, the invention guarantees production of long drawn products having a high-quality surface owing to the integration of the cropping station in the drawing line (integration which was not possible with the state of the art drawing devices).

What is claimed is:

1. Device for drawing a long metallic product having a tapered end, comprising, in series, a drawing block having an outlet for the long metallic product and a traction means having an inlet oriented to receive the long metallic product from the outlet of the drawing block and an outlet, said traction means comprising two closely oriented drive belts rotating in opposite directions for linearly driving the long metallic product drawn from said drawing block, said device for drawing further comprising an automatic engagement means for engaging the tapered end of the long metallic product from the outlet of the drawing block to the outlet of the traction means, and comprising an auxiliary traction means powered by said traction means, said auxiliary traction means having a first end integral with a means for automatic attachment to and detachment from the tapered end of the long metallic product and having a length such that when said means for automatic attachment and detachment is attached to the tapered end of the long metallic product at the outlet of said drawing block, the auxiliary traction means is in engagement at the other end thereof with said traction means, said automatic engagement means further comprising a guide means for said auxiliary traction means over at least a part of a trajectory extending form the outlet of the drawing block to the outlet of the traction means and at the outlet of the traction means, and a means for forward and reverse travel of the auxiliary traction means comprising said traction means.

2. Device according to claim 1, wherein said forward and reverse travel means also comprises a secondary means for displacing and engaging or disconnecting said attachment means with said traction device at the outlet thereof.

3. Device according to any one of claim 1, wherein said auxiliary traction means is selected so as to have, in forward travel, sufficient resistance to traction to be able to pull said long product from the outlet of said drawing block through a cooling block to the outlet of said traction device and to have, in reverse travel, sufficient resistance to compression for said automatic attachment and detachment means to be displaced to the outlet of said drawing block owing to said guide means.

4. Device according to claim 3, wherein said auxiliary traction means is a steel ribbon having a lateral position ensured by rails constituting said guide means.

5. Device according to claim 2 which further comprises, at the outlet of said traction means, a guide and parking means for said auxiliary traction means and said attachment means.

6. Device according to claim 1, wherein said secondary means is a driving shaft or a jack.

7. Device according to 1, wherein said automatic attachment and detachment means comprises two cams with orientated teeth allowing gripping of said tapered end once and while the automatic attachment and detachment means exerts traction on said end in forward travel.

8. Device according to claim 7, wherein said cams have a profile in the form of a logarithmic spiral so as to exert a pressure on said end, this pressure being proportional to the traction for manufacturing tubes of which the diameters can vary within a fairly wide range.

9. Device according to claim 1, further comprising a cooling block with which a wiping box is associated.

10. Device according to claim 9, wherein said wiping box includes a central orifice adapted to the drawn product and is translatable by means of said guide means and by thrust of said attachment means to the outlet of said drawing block.

11. Device according to claim 1, wherein said traction means comprises caterpillar tracks.

12. Device according to claim 1, intended for the drawing of tubes and comprising, at the outlet of the drawing block, a means for forming a notch to reduce the internal diameter of said tube and, during start up, to facilitate positioning of a mandrel adapted for each die for a drawing block.

13. Device according to claim 1, further comprising:

a) means for reverse operation of said secondary means so as to present said attachment means at the outlet of the traction device, b) means for stoppage of said secondary means during reverse operation of said traction means, c) means for reverse operation of the traction means until said attachment means has gripped said tapered end, d) means for forward operation of the traction means, and optionally automatic production of a notch after travel of said end over a predetermined length, and e) when said attachment means arrives at the outlet of said traction device, means for temporary forward travel of said secondary means to remove said attachment means from the outlet of said traction device;

the device thereby comprising means for automating sequential implementation of movements allowing implementation of said automatic engagement means.

14. Drawing line comprising at least two drawing devices according to claim 1, providing drawing passes in series which comprises, between two successive drawing devices, a regulating system for guiding and long drawn product toward an inlet of a following drawing block or toward a cropping station.

15. Drawing line according to claim 14, wherein said regulating system allows the formation of a loop of said long drawn product and comprises travel means.

16. Line according to claim 15 which comprises means for checking position and speed of said long product means for checking diameter of each regulating loop means for synchronizing various linear velocities of said long drawn products at the outlet of each drawing block by acting on the speed imposed on the traction devices and/or on the travel means so that there is no accumulation of or excessive tension in said long drawn products between two successive drawing blocks.

* * * * *

UNITED STATES PATENT AND TRADEMARK OFFICE

CERTIFICATE OF CORRECTION

PATENT NO. : 5,660,071

DATED : August 26, 1997

INVENTOR(S) : JEAN-LOUIS SAUVONNET et al

It is certified that error appears in the above-indentified patent and that said Letters Patent is hereby corrected as shown below:

Claim 3, line 1, delete "any one of".

Signed and Sealed this

Sixteenth Day of December, 1997

Bruce Lehman

*Attest:*

BRUCE LEHMAN

*Attesting Officer*

*Commissioner of Patents and Trademarks*